US011401937B2

(12) United States Patent
Jang et al.

(10) Patent No.: US 11,401,937 B2
(45) Date of Patent: Aug. 2, 2022

(54) SCROLL COMPRESSOR HAVING WEAR PREVENTING MEMBER LOCATED BETWEEN KEY PORTION OF ORBITING SCROLL AND KEY OF OLDHAM RING

(71) Applicant: LG ELECTRONICS INC., Seoul (KR)

(72) Inventors: Jinyong Jang, Seoul (KR); Byungkil Yoo, Seoul (KR); Byeongchul Lee, Seoul (KR); Woogyong Yim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 415 days.

(21) Appl. No.: 16/406,131

(22) Filed: May 8, 2019

(65) Prior Publication Data

US 2019/0345940 A1 Nov. 14, 2019

(30) Foreign Application Priority Data

May 9, 2018 (KR) ..... 10-2018-0053335

(51) Int. Cl.
*F04C 29/00* (2006.01)
*F01C 17/06* (2006.01)
*F04C 18/02* (2006.01)

(52) U.S. Cl.
CPC ..... *F04C 29/0071* (2013.01); *F01C 17/066* (2013.01); *F04C 18/0215* (2013.01); (Continued)

(58) Field of Classification Search
CPC ..... F04C 29/0071; F04C 18/0215; F04C 29/0057; F04C 2240/801; F04C 2240/802; F04C 2270/16; F01C 17/066
See application file for complete search history.

(56) References Cited

U.S. PATENT DOCUMENTS 5,125,810 A * 6/1992 Suefuji ..... F04C 18/0215 418/55.2
5,275,543 A 1/1994 Tanaka et al.
(Continued)

FOREIGN PATENT DOCUMENTS

EP 3199753 A1 8/2017
JP H03267501 A 11/1991
(Continued)

OTHER PUBLICATIONS

Office Action dated Mar. 17, 2021, by European Patent Office on EP Application No. 19173340.1.
European Search Report dated Sep. 25, 2019.

*Primary Examiner* — Dominick L Plakkoottam
*Assistant Examiner* — Paul W Thiede
(74) *Attorney, Agent, or Firm* — Birch, Stewart, Kolasch & Birch, LLP

(57) ABSTRACT

A scroll compressor includes a first scroll and a second scroll engaged with the first scroll to form a compression chamber with the first scroll while performing an orbiting movement with respect to the first scroll. A frame is fixed to a side of the first scroll with the second scroll interposed between the frame and the first scroll and the frame supporting the second scroll in an axial direction. An Oldham ring includes a ring portion and a key portion protruding from the ring portion. The key portion is slidably coupled to a key recess in the frame or the second scroll to enable the second scroll to perform the orbiting movement, and the key portion of the Oldham ring is formed of the same material as the second scroll. A wear preventing member is provided between the key portion and the key recess.

11 Claims, 10 Drawing Sheets

(52) U.S. Cl.
CPC .... *F04C 29/0057* (2013.01); *F04C 2240/801* (2013.01); *F04C 2240/802* (2013.01); *F04C 2270/16* (2013.01)

(56) References Cited

U.S. PATENT DOCUMENTS

| | | | | |
|---|---|---|---|---|
| 6,071,100 | A * | 6/2000 | Yamada | F01C 17/066 418/55.3 |
| 6,261,072 | B1 | 7/2001 | Abe et al. | |
| 11,008,867 | B2 * | 5/2021 | Jang | F01C 17/066 |
| 2017/0234313 | A1 | 8/2017 | Fullenkamp et al. | |
| 2017/0306952 | A1 * | 10/2017 | Choi | F04C 18/0261 |
| 2018/0073506 | A1 | 3/2018 | Choi et al. | |
| 2019/0211679 | A1 * | 7/2019 | Jang | F01C 17/066 |
| 2019/0345941 | A1 * | 11/2019 | Yoo | F01C 17/066 |

FOREIGN PATENT DOCUMENTS

| | | | |
|---|---|---|---|
| JP | H07247966 | A | 9/1995 |
| JP | 2017-133466 | A | 8/2017 |
| KR | 10-1997-0021751 | A | 12/1998 |
| KR | 1999-0062958 | | 7/1999 |
| KR | 10-1718045 | B1 | 3/2017 |

* cited by examiner

SCROLL COMPRESSOR HAVING WEAR PREVENTING MEMBER LOCATED BETWEEN KEY PORTION OF ORBITING SCROLL AND KEY OF OLDHAM RING

CROSS-REFERENCE TO RELATED APPLICATION

Pursuant to 35 U.S.C. § 119(a), this application claims the benefit of earlier filing date and right of priority to Korean Application No. 10-2018-0053335, filed on May 9, 2018, the contents of which are incorporated by reference herein in their entirety.

BACKGROUND OF THE DISCLOSURE

1. Field of the Disclosure

The present disclosure relates to a compressor, and particularly, to a scroll compressor.

2. Background of the Disclosure

In a scroll type compressor, a motor part formed as a rotary motor is installed inside a closed casing, a compression unit including a fixed scroll and an orbiting scroll is installed on one side of the motor part, and the motor part and the compression part are connected by a rotating shaft so that a rotational force of the motor part is transmitted to the compression unit. The rotational force transmitted to the compression unit causes the orbiting scroll to perform an orbiting movement with respect to the fixed scroll to form a pair of two compression chambers including a suction chamber, an intermediate compression chamber and a discharge chamber, so that a refrigerant is sucked into both compression chambers and compressed and simultaneously discharged.

Such a scroll-type compressor is provided with a rotation preventing mechanism for preventing rotation of the orbiting scroll. As the rotation preventing mechanism, an Oldham ring or a pin-and-ring may be applied.

The pin-and-ring type is advantageous compared with the above-mentioned Oldham ring type in that reliability is improved due to enhancement of durability of the rotation preventing mechanism and an increase in weight of the compressor due to the rotation preventing mechanism is suppressed. Meanwhile, the pin-and-ring type is relatively disadvantageous in terms of assembly since a plurality of pins and rings must be installed in each of the orbiting scroll and a member in contacting therewith. Therefore, research has been continuing to replace the pin-and-ring type by improving a material of the Oldham ring.

Particularly, when the scroll compressor is applied to an automotive air conditioning system, the Oldham ring may be formed of aluminum material in consideration of the weight and workability of the compressor. When aluminum is applied to the Oldham ring, the weight of the Oldham ring may be lowered and workability and productivity may be improved.

However, when the weight of the compressor is considered, it is advantageous to manufacture the peripheral orbiting scroll, a main frame, or the fixed scroll, as well as the Oldham ring, and in this case, since the material of the aluminum Oldham ring and a material of a relative frictional surface are the same, friction characteristics are significantly degraded. Recently, a technique for improving wear reliability of a key portion of the Oldham ring has been introduced.

Prior Art 1 (US 2017-0234313 A) is a technique for increasing wear resistance, while reducing the weight of the Oldham ring by forming a ring portion and a key portion of the Oldham ring with different materials. Prior Art 2 (KR 10-1997-0021751) is a technique for surface-treating the Oldham ring to suppress the Oldham ring from being welded to the orbiting scroll or the fixed scroll.

However, in the conventional scroll compressor as described above, when the ring portion and the key portion of the Oldham ring are made of different materials in consideration of the weight and reliability of the compressor, a manufacturing process of post-assembling the ring portion and the key portion may be complicated. Also, in this case, a sectional area of a portion where the ring portion and the key portion are assembled may be reduced, so that a bearing strength against the key portion is weakened, and reliability with respect to the bearing may be lowered. Also, in this case, a gap is generated at a joint portion of the ring portion and the key portion due to a machining error or an assembly error between the ring portion and the key portion, and when the compressor is driven, the key portion is warped relative to the ring portion so that the orbiting scroll is pushed in a circumferential direction, resultantly forming a gap between the wraps to increase compression loss. Also, coefficients of thermal expansion of the ring portion and the key portion are different from each other, resulting in separation of the key portion from the ring portion or idling.

In the conventional scroll compressor, a coating layer may be formed on a surface of the Oldham ring with a lubricating material or the like. However, manufacturing cost is increased due to formation of a separate coating layer, and the coating layer is peeled off or worn when it is used for a long time to damage the Oldham ring or increase friction loss.

PRIOR ART DOCUMENTS

Prior art 1: US Laid-open Publication No. US 2017-0234313 A(2017 Aug. 17)

Prior art 2: Korean Laid-open Publication No. 10-1997-0021751 (1997 May 28)

SUMMARY OF THE DISCLOSURE

Therefore, an aspect of the detailed description is to provide a scroll compressor having an overall weight reduced by reducing a weight of an Oldham ring, when the Oldham ring is applied.

Further, another aspect of the detailed description is to provide a scroll compressor in which an Oldham ring is formed of the same material as that of a frame to which the Oldham ring is coupled, an orbiting scroll, or a fixed scroll.

Further, another aspect of the detailed description is to provide a scroll compressor in which both members to which an Oldham ring is coupled are formed of the same material and the Oldham ring is formed of the same material as that of the both members to which the Oldham ring is coupled.

Further, another aspect of the detailed description is to provide a scroll compressor in which a ring portion and a key portion forming an Oldham ring are formed of the same material.

Further, another aspect of the detailed description is to provide a scroll compressor capable of enhancing workability and productivity for an Oldham ring.

Further, another aspect of the detailed description is to provide a scroll compressor in which generation of a gap of an allowable value or greater between a key portion of an Oldham ring and a key recess of a frame, an orbiting scroll, or a fixed scroll to which the key portion is coupled is suppressed to increase compressor efficiency.

Further, another aspect of the detailed description is to provide a scroll compressor capable of securing a bearing strength of a key portion with respect to a ring portion forming an Oldham ring, thereby enhance reliability.

Further, another aspect of the detailed description is to provide a scroll compressor capable of suppressing idling of a key portion with respect to a ring portion forming an Oldham ring, thereby enhancing reliability.

Further, another aspect of the detailed description is to provide a scroll compressor in which a ring portion and a key portion forming an Oldham ring are formed as a single body.

To achieve these and other advantages and in accordance with the purpose of this specification, as embodied and broadly described herein, a scroll compressor includes: a first scroll; a second scroll engaged with the first scroll and performing an orbiting movement; and an Oldham ring including a ring portion formed in a ring shape and a key portion protruding from the ring portion, wherein the key portion is slidably coupled to a key recess provided in the second scroll to enable the second scroll to perform an orbiting movement with respect to the first scroll, wherein the key portion of the Oldham ring is formed of the same material as the second scroll.

Here, a wear preventing member formed of a material different from the second scroll or the Oldham ring may be provided between the key portion and the key recess.

The wear preventing member may be inserted into the key recess so as to be coupled.

An escape preventing portion for preventing the wear preventing member from escaping may be formed between the wear preventing member and a member to which the wear preventing member is coupled.

To achieve these and other advantages and in accordance with the purpose of this specification, as embodied and broadly described herein, a scroll compressor includes: a first scroll; a second scroll engaged with the first scroll to perform an orbiting movement to form a compression chamber with the first scroll; and an Oldham ring including a ring portion formed in a ring shape and a key portion protruding from the ring portion, wherein the key portion is slidably coupled to a key recess provided in the second scroll to enable the second scroll to perform an orbiting movement with respect to the first scroll, wherein a wear preventing member is provided between the key recess of the second scroll and the key portion of the Oldham ring.

Here, the key portion of the Oldham ring may be formed of the same material as the second scroll, and the wear preventing member may be formed of a material different from the key recess of the second scroll or the key portion of the Oldham ring.

The key portion and the ring portion of the Oldham ring may be formed of the same material.

The key portion and the ring portion of the Oldham ring may be formed as a single body.

The wear preventing member may include a first reinforcement surface and a second reinforcement surface arranged in parallel in a radial direction and a connection surface connecting the first reinforcement surface and the second reinforcement surface, and the connection surface extends from first ends of the first reinforcement surface and the second reinforcement surface facing each other in the radial direction to connect the first reinforcement surface and the second reinforcement surface.

The connection surface may be formed to expand in a circumferential direction, relative to an interval between the first reinforcement surface and the second reinforcement surface, and an escape preventing recess into which the connection surface is inserted to support the wear preventing member in the radial direction may be formed at one end of the key recess.

Here, the connection surface may have the same diameter as the interval between the first reinforcement surface and the second reinforcement surface, and a fixing pin may be coupled to one end of the key recess to support the connection surface in the radial direction.

Here, the connection surface may have the same diameter as the interval between the first reinforcement surface and the second reinforcement surface, and an escape preventing recess into which one axial end of the wear preventing member is inserted and supported may be formed in the key recess.

Here, the wear preventing member may include a first reinforcement surface and a second reinforcement surface arranged in parallel in a radial direction and a third reinforcement surface extending from first axial ends where the first reinforcement surface and the second reinforcement surface are facing each other in a circumferential direction to connect the first reinforcement surface and the second reinforcement surface.

Escape preventing surfaces may be further formed on the first reinforcement surface and the second reinforcement surface and extend from first facing ends of the first reinforcement surface and the second reinforcement surface to support the wear preventing member in the radial direction, and an escape preventing recess may be formed at one end of the key recess and expand, relative to a width of the key recess, in the circumferential direction, into which the escape preventing surface is inserted.

Here, an oil storage recess may be formed to be deeper than a bottom surface of the key recess in the second scroll, and the oil storage recess may be formed to communicate with the key recess outside a movement range of the key portion.

To achieve these and other advantages and in accordance with the purpose of this specification, as embodied and broadly described herein, a scroll compressor includes: a casing; a driving motor in which a stator is fixed to an inner space of the casing and a rotor is rotatably provided in the stator; a first scroll provided on one side of the driving motor; a second scroll engaged with the first scroll to form a compression chamber with the first scroll, while performing an orbiting movement, and having a plurality of first key recesses; a rotating shaft in which one end is coupled to the rotor of the driving motor and the other end is eccentrically coupled to the second scroll so as to overlap with the compression chamber in an axial direction; a frame provided on the opposite side of the first scroll with the second scroll interposed therebetween and having a plurality of second key recesses; an Oldham ring having a ring portion located between the frame and the second scroll and a plurality of key portions protruding from the ring portion and slidably inserted into the first key recess and the second key recess; and a wear preventing member formed of a material different from the Oldham ring or the second scroll and provided between the first key recess or the second key recess and the key portion of the Oldham ring inserted therein.

Here, the Oldham ring may be formed of the same material as the second scroll or the frame.

The ring portion and the key portion of the Oldham ring may be formed of the same material and formed as a single body.

The wear preventing member may be inserted into the first key recess or the second key recess and an escape preventing portion may be provided between the first key recess or the second key recess and the wear preventing member inserted therein to suppress escaping of the wear preventing member from the key recess in the radial direction.

In the scroll compressor according to the present invention, since an wear preventing member is provided between the key portion and the key recess of the frame, the orbiting scroll, or the fixed scroll into which the key portion is inserted, the Oldham ring is prevented from being in direct contact with the frame, the orbiting scroll or the fixed scroll. As a result, the ring portion and the key portion forming the Oldham ring may be formed of lightweight aluminum, which may reduce the weight of the Oldham ring and the weight of the compressor to which the Oldham ring is applied.

Further, according to the present invention, it is possible to prevent the frictional characteristic due to a friction between the same material from being lowered, even though the Oldham ring of the scroll compressor according to the present invention is formed of the same material as that of the frame, the orbiting scroll, or the fixed scroll to which the key portion of the Oldham ring is coupled. As a result, it is possible to reduce friction between the Oldham ring and the member to which the Oldham ring is coupled, thus reducing damage to the Oldham ring or a counterpart member and reducing a friction loss to thus increase compressor efficiency.

Furthermore, in the Oldham ring of the scroll compressor according to the present invention, since the ring portion and the key portion forming the Oldham ring are formed as a single body, it is easy to manufacture the Oldham ring. In addition, it is possible to suppress the phenomenon that the key portion of the Oldham ring is twisted in the key recess of the counterpart member when the compressor is driven, thereby suppressing the orbiting scroll from being pushed in the circumferential direction, thereby reducing compression loss caused by a spacing between the wraps. Further, it is possible to secure strength against a root portion of the key portion protruding from the ring portion, thereby suppressing damage of the key portion, thereby enhancing reliability.

Further, in the forming the Oldham ring of the scroll compressor according to the present invention, since the ring portion and the key portion forming the Oldham ring are formed as a single body and formed of the same material, the key portion is prevented from being excessively deformed or idly rotated even though the Oldham ring is heated when the compressor is driven. Thus, it is possible to prevent the behavior of the orbiting scroll from becoming unstable due to the Oldham ring.

Further, in the scroll compressor according to the present invention, the wear preventing member is provided between the key portion of the Oldham ring and the key recess of the frame, the orbiting scroll, or the fixed scroll into which the key portion is inserted, and a separation prevention portion is formed between one end of the wear preventing member and the corresponding key recess to fix the wear preventing member. As a result, it is possible to effectively prevent the wear preventing member from being separated from the key recess, thereby increasing reliability.

Further, the separation prevention portion may be easily formed by forming a protrusion on the wear prevention portion and a recess on the corresponding key recess, or the wear preventing member may be fixed using a separate fixing pin. When the wear preventing member is fixed by using a separate fixing pin, the entire radial length of the key recess including the escape preventing portion may be reduced, and the diameter of the key recess for the inner circumference may be increased. This may enlarge the area of the back pressure space formed inside the abovementioned Oldham ring and stably support the orbiting scroll as much.

Furthermore, the wear preventing member may be formed to correspond to the circumferential side surface of the key recess and the bottom surface connecting the both side surfaces thereof. Accordingly, it is possible to suppress contact between the key portion and the key recess even at the one axial side surface corresponding to the bottom surface of the key recess, as well as at both circumferential side surfaces between the key portion and the key recess. Then, when the behavior of the orbiting scroll is unstable, the key portion and the key recess are prevented from coming into contact with each other in the axial direction to cause wearing.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a scroll compressor according to the present invention will be described in detail with reference to an embodiment shown in the accompanying drawings.

Figure 1:
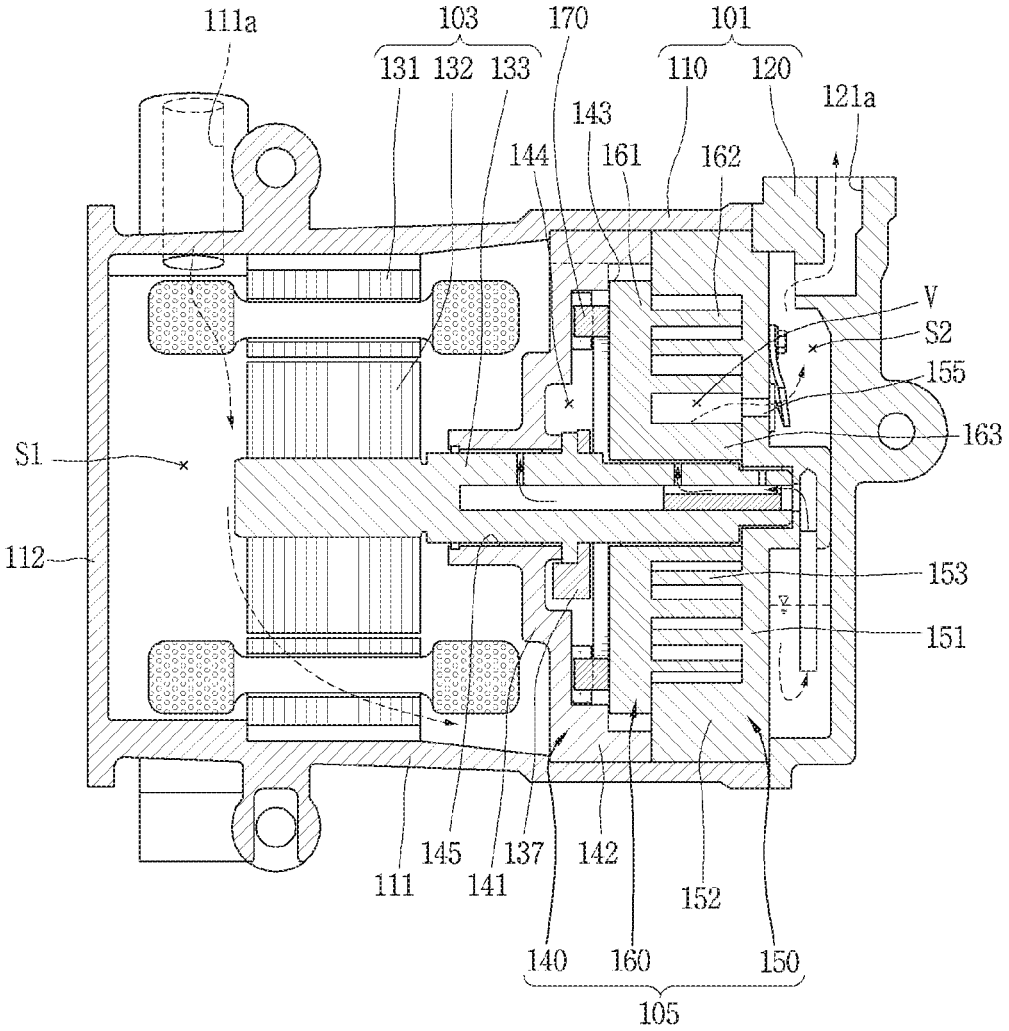
FIG. 1 is a cross-sectional view showing an inside of an electric compressor as an example of a scroll compressor according to the present invention.
Figure 2:
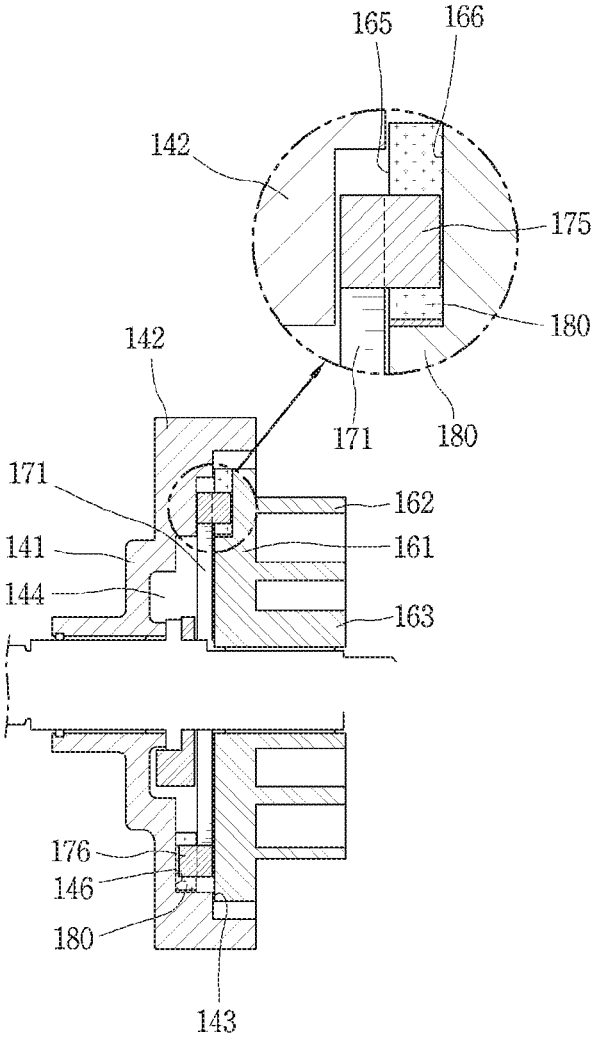
FIG. 2 is a cross-sectional view showing a state that an Oldham ring is coupled between a frame and an orbiting scroll in a compression unit according to FIG. 1.

FIG. 1 is a cross-sectional view showing the inside of an electric compressor as an example of a scroll compressor according to the present invention, and FIG. 2 is a cross-sectional view showing a state that an Oldham ring is coupled between a frame and an orbiting scroll in a compression unit according to FIG. 1.

As shown in these figures, the scroll compressor according to the present embodiment includes a driving motor 103 which is a motor part and a compression unit 105 compressing a refrigerant using a rotational force of the driving motor 103 inside a compressor casing 101.

The compressor casing 101 is provided with an intake port 111*a* to which a suction pipe is connected and an exhaust port 121*a* to which a discharge pipe is connected. A suction space S1 communicates with the intake port 111*a* and a discharge space S2 communicates with the exhaust port 121*a*. The driving motor 103 is installed in the suction space S1, and the compressor of the present embodiment is a low pressure type compressor.

The compressor casing 101 includes a main housing 110 in which the driving motor 103 is installed and a rear housing 120 coupled to an opened rear end of the main housing 110. An inner space of the main housing 110 forms the suction space S1 together with one side surface of the compression unit 105 and an inner space of the rear housing 120 forms the discharge space S2 together with the other side surface of the compression unit 105. In the rear housing 120, the above-described exhaust port 121*a* is formed.

The main housing 110 has a cylindrical portion 111 formed in a cylindrical shape and a front end of the cylindrical portion 111 is integrally extended to form a closed portion 112. The rear end of the cylindrical portion 111 is opened and the rear housing 120 is sealed and coupled.

Meanwhile, the driving motor 103 constituting a motor part is press-fitted into the main housing 110. The driving motor 103 includes a stator 131 fixed inside the main housing 110 and a rotor 132 positioned inside the stator 131 and rotated by interaction with the stator 131.

The stator 131 is fixed as a stator core (no reference numeral) is shrink-fitted to the inner circumferential surface of the main housing. In the rotor 132, the rotating shaft 133 is press-fitted to the inner circumferential surface of the rotor core (no reference numeral).

The rotating shaft 133 is coupled to the center of the rotor 132 and a rear end facing the compression unit 105 is supported by the frame 140 (to be described) and the fixed scroll 150 in a cantilevered manner.

The compression unit 105 includes the frame 140, a fixed scroll (hereinafter referred to as a first scroll) 150 supported by the frame 140, and an orbiting scroll (hereinafter referred to as a second scroll) 160 provided between the frame 140 and the first scroll 150 and making an orbiting movement.

The frame 140 is coupled to the front opening of the main housing 110, the first scroll 150 is fixedly supported on the rear surface of the frame 140 and the second scroll 160 is rotatably supported on the rear surface of the frame 140 to perform an orbiting movement between the first scroll 150 and the frame 140. The second scroll 160 is eccentrically coupled to the rotating shaft 133 coupled to the rotor 132 of the driving motor 103 and performs an orbiting movement relative to the first scroll 150 to form a pair of two pair of compression chambers V including suction chamber, an intermediate pressure chamber, and a discharge chamber.

The frame 140 includes a frame disk plate portion 141 having a disk shape and a frame side wall portion 142 protruding from a rear side surface toward the first scroll 150 to allow the side wall portion 152 of the first scroll 150 to be described later.

A frame thrust surface 143 is formed on the inner side of the frame side wall portion 142 and supported by the second scroll 160 to be axially supported. A back pressure space 144 in which a portion of a refrigerant compressed in the compression chamber V is filled with oil to support the back surface of the second scroll 160 is formed. Accordingly, the pressure in the back pressure space 144 forms an intermediate pressure between the pressure in the suction space S1 and the final pressure (i.e., the discharge pressure) in the compression chamber V.

A frame shaft hole 145 through which the rotating shaft 133 passes is formed in the back pressure space 144 and a first bearing (not shown) is provided on the inner circumferential surface of the frame shaft hole 145. The first bearing may be made of a bush bearing, but in some cases it may be a ball bearing. However, since the bush bearing is less expensive than the ball bearing, it is advantageous not only in cost but also in ease of assembly and weight and noise reduction.

On the inner side of the frame thrust surface 143, a second key recess 146 is formed in which a second key portion 176 of an Oldham ring 170 to be described later is slidably inserted. Two second key recesses 146 are typically formed at intervals of 180 degrees. The second key recesses 146 will be described later together with a friction preventing member.

Meanwhile, the first scroll 150 may be fixedly coupled to the frame 140 or may be press-fitted into the casing 110 to be fixed.

The first scroll 150 has a fixed scroll disk plate portion 151 (hereinafter, fixed side disk plate portion) 151 having a substantially disk shape and a fixed scroll side wall portion (hereinafter, first side wall portion) 152 formed at the edge of the fixed side disk plate portion 151 and coupled to the side wall portion 142 of the frame 140. On a front surface of the fixed side disk plate portion 151, a fixed side wrap 153 which is engaged with the orbiting side wrap 162 to be described later and constitutes the compression chamber (V) is formed.

A suction flow path (not shown) is formed at one side of the first side wall portion 152 so that the suction space S1 and a suction chamber (not shown) communicate with each other, and a discharge port 155 communicating with the discharge chamber and discharging a compressed refrigerant to the discharge space S2 is formed at a central portion of the fixed side disk plate portion 151.

Meanwhile, the second scroll 160 is provided between the frame and the first scroll 150, and eccentrically coupled to a rotating shaft 133 to perform an orbiting movement.

In the second scroll 160, an orbiting scroll disk plate portion (hereinafter, orbiting side disk plate portion) 161 is formed to have a substantially disc shape, and an orbiting side wrap 162 engaged with the fixed side wrap 153 to form a compression chamber is formed on the rear surface of the orbiting side disk plate portion 161. The orbiting side wrap 162 may have an involute shape together with the fixed side wrap 153, but it may also have various other shapes.

On the front surface of the orbiting side disk plate portion 161, a scroll-side thrust surface 165 corresponding to the frame-side thrust surface 143 and forming a thrust surface is formed. However, since the second scroll 160 floats against the frame 140 when the compressor is driven, the frame-side thrust surface 143 and the scroll-side thrust surface 165 are substantially not in contact with each other. Rather, the frame 140 and the second scroll 160 form a thrust surface with the ring portion 171 of the Oldham ring 170 to be described later.

A first key recess 166 into which the first key portion 175 of the Oldham ring 170 to be described later is slidably inserted is formed in the middle of the scroll-side thrust surface 165. Two first key recesses 166 are formed at intervals of 180 degrees. The first key recess 166 is formed with a phase difference of about 90 degrees with the second key recess 146 in an axial direction projection. The first key recess will be described later together with the friction preventing member.

Meanwhile, a rotation preventing mechanism is provided between the frame 140 and the second scroll 160 to prevent rotation of the second scroll 160. The rotation preventing mechanism may be installed between the first scroll 150 and the second scroll 160 in some cases. Hereinafter, an example in which the rotation preventing mechanism is provided between the frame 140 and the second scroll 160 will be described as an example.

The rotation preventing mechanism may be a pin-and-ring type as described above, or an Oldham ring type. The present embodiment relates to the case where the Oldham ring is applied.

The Oldham ring includes a ring portion 171 formed in an annular shape and a plurality of first key portions 175 and a plurality of second key portions 176 protruding from both side surfaces in the axial direction of the ring portion 171. The structure of the Oldham ring will be described later together with the friction preventing member.

In FIG. 1, the reference numeral 137 is a balance weight.

The scroll compressor according to this embodiment operates as follows.

That is, when power is applied to the driving motor 103, the rotating shaft 133 rotates together with the rotor 132 to transmit a rotational force to the second scroll 160, and the second scroll 160 makes an orbiting movement by the Oldham ring 170 which is a rotation preventing mechanism, and thus, the compression chamber V is continuously moved toward the center side and the volume of the compression chamber V is reduced.

The refrigerant flows into the suction space S1 through the intake port 111*a* and the refrigerant introduced into the suction space S1 passes through a flow path formed in the outer circumferential surface of the stator 131 and the inner circumferential surface of the main housing 110 or an air gap between the stator 131 and the rotor 132 and is sucked to the compression chamber V through a suction flow path 154.

At this time, a part of the refrigerant sucked into the suction space S1 through the intake port 111*a* first comes into contact with closed portion 112 which is the front surface of the main housing 110, before passing through the driving motor 103. Accordingly, the closed portion 112 is heat-exchanged with the cold suction refrigerant and cooled, thereby dissipating heat in an inverter module (not shown) attached to the closed portion 112 of the main housing 110.

The refrigerant sucked into the compression chamber V through the suction space S1 is compressed by the first scroll 150 and the second scroll 160 and is discharged into the discharge space S2 through the discharge port 155. Oil of the refrigerant discharged to the discharge space S2 is separated at the discharge space S2 and the refrigerant is discharged to the refrigerating cycle through the exhaust port 121*a* while the oil is collected at a lower portion of the discharge space S2 and supplied to the respective bearing surfaces or to the compression chamber through an oil flow path (not shown).

At this time, a part of the oil flows into a space between the frame 140 and the second scroll 160 to lubricate between the Oldham ring 170 and the frame 140 to which the Oldham ring 170 is coupled or the second scroll 160.

Meanwhile, the scroll compressor as described above is widely applied not only to an air conditioning system in a building but also to an air conditioning system in a vehicle. Scroll compressors may increase compressor efficiency by reducing a weight of a moving member, similarly to other compressors. Particularly, when installed in a vehicle, it is advantageous to reduce the weight of the compressor since the weight of the entire compressor as well as the rotating member is related to the weight of the vehicle.

Accordingly, in a scroll compressor (generally called an electric scroll compressor) applied to a vehicle, a casing, a frame, a fixed scroll and an orbiting scroll as well as an Oldham ring may be made of a lightweight material such as aluminum (aluminum alloy).

However, as described above, when the Oldham ring and the frame or the orbiting scroll contacting the Oldham ring is formed of an aluminum material, friction characteristics depending on the same material may be deteriorate, unlike cast iron.

Taking this into consideration, it is considered to form the ring portion and the key portion of the Oldham ring by different materials and assembled or to form the entire Oldham ring of the same material and form a coating layer for improving friction characteristics on the surface of the Oldham ring. However, these methods have limitations in workability and reliability as described above.

Accordingly, the present invention is to improve the workability of the above-mentioned bearing by forming the entire Oldham ring with the same kind of material and forming the frame or the orbiting scroll to which the Oldham ring is coupled with the same material as the Oldham ring, while preventing deterioration of friction characteristics according to the same material, to ensure the reliability of the compressor.

Figure 3:
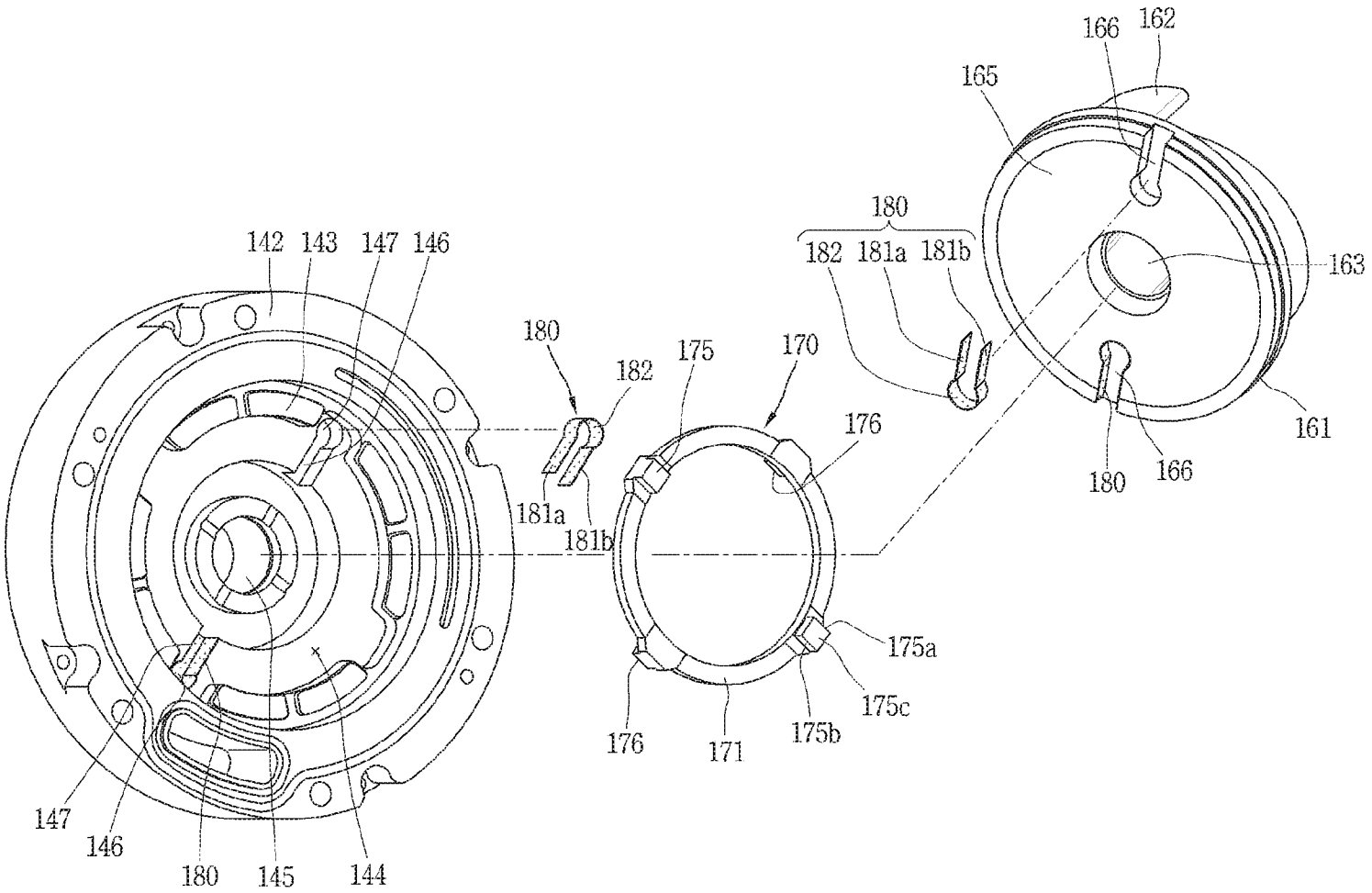
FIG. 3 is an exploded perspective view of the compression unit according to FIG. 2.
Figure 4:
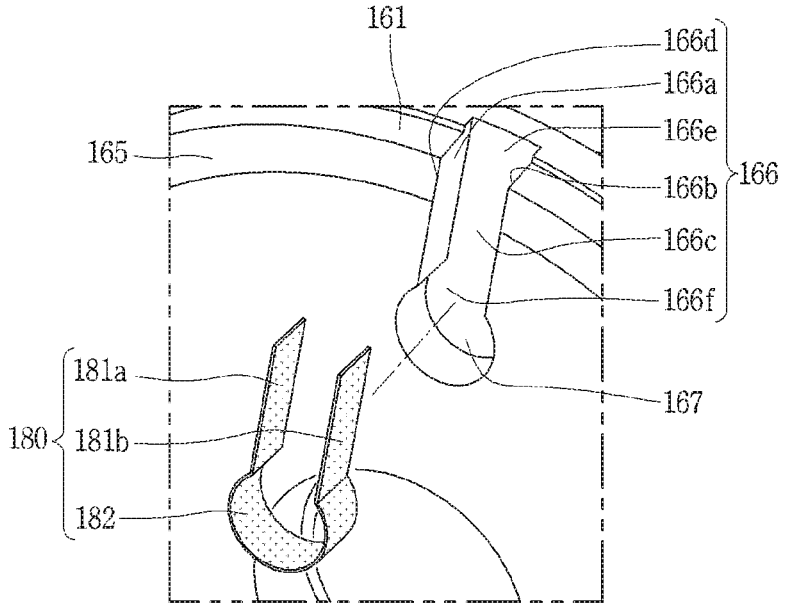
FIG. 4 is a perspective view showing a state that a wear preventing member is separated from an orbiting scroll in the compression unit according to FIG. 3.
Figure 5:
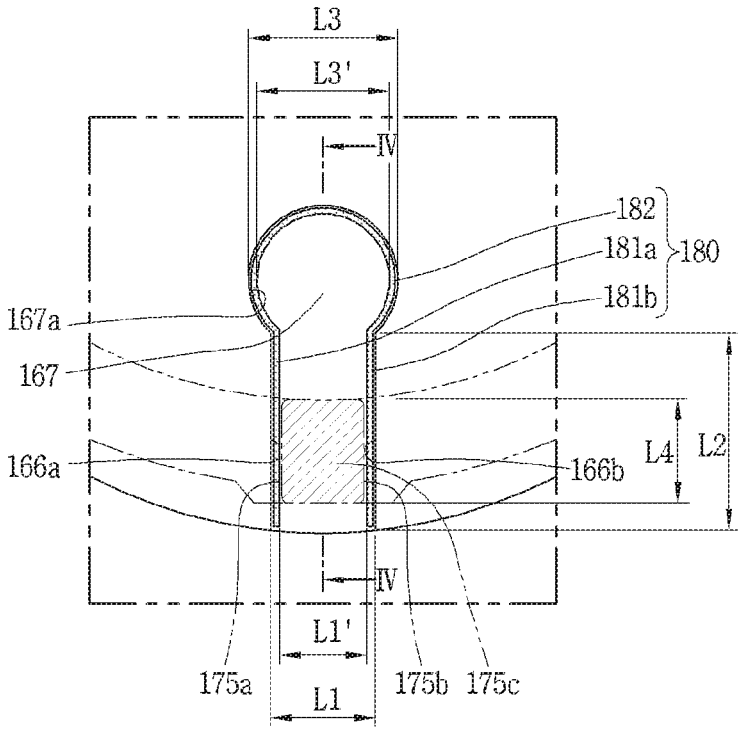
FIG. 5 is a plan view showing a state where a wear preventing member is coupled to an orbiting scroll in FIG. 4.
Figure 6:
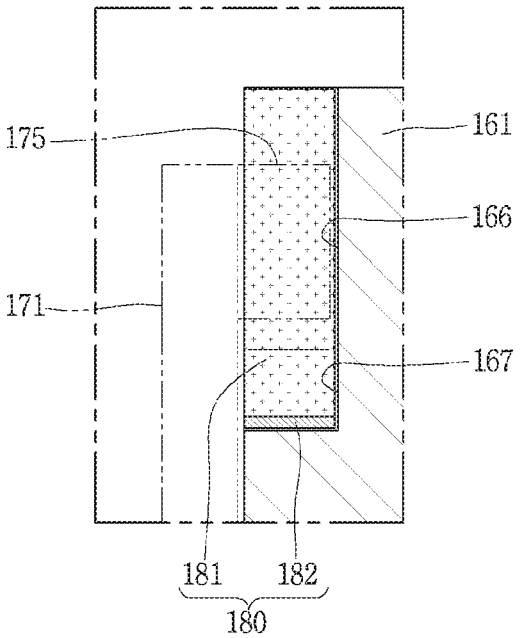
FIG. 6 is a cross-sectional view taken along line "IV-IV" in FIG. 5.

FIG. 3 is an exploded perspective view of the compression unit according to FIG. 2, FIG. 4 is a perspective view showing a state that a wear preventing member is separated from an orbiting scroll in the compression unit according to FIG. 3, FIG. 5 is a plan view showing a state where a wear preventing member is coupled to a key recess of an orbiting scroll in FIG. 4, and FIG. 6 is a cross-sectional view taken along line "IV-IV" in FIG. 5.

The frame 140, the second scroll 160, and the Oldham ring 170 are all formed of an aluminum material that is lighter than cast iron. The specific gravity of the cast iron is about 7.85, and the specific gravity of the aluminum alloy is about 2.8. Accordingly, when the frame, the second scroll, and the Oldham ring are all made of aluminum, the weight of the compressor may be greatly reduced.

The Oldham ring may include a ring portion 171 formed in an annular shape and a first key portion 175 and a second key portion 176 protruding from both side surfaces of the ring portion 171 in the axial direction. A plurality of first key portions 175 are formed on one axial side surface of the ring portion 171 and plurality of second key portions 176 are formed on the other axial side surface of the ring portion 171. The plurality of first key portions 175 and the second key portions 176 are formed at intervals of 180 degrees along the circumferential direction so that the first key portions 175 and the second key portions 176 are formed at intervals of 90 degrees with respect to each other.

The first key portion 175 and the second key portion 176 are each formed in a rectangular cross-sectional shape extending in the radial direction. However, the first key portion 175 and the second key portion 176 may be formed to have a square cross section or a shape having a similar length in some cases. This will be explained later with the key recess.

The ring portion 171 and the key portions 175 and 176 are formed as a single body. That is, the first key portion 175 and the second key portion 176 are formed integrally with the ring portion 171. Accordingly, the ring portion 171 and the key portions 175 and 176 are made of the same kind of material, that is, the entire Oldham ring is formed of an aluminum material.

A plurality of first key recesses 166 corresponding to the first key portion 175 of the Oldham ring 170 are formed at the second scroll 160 and a plurality of second key recesses 146 corresponding to the second key portion 176 of the Oldham ring 170 are formed at the frame 140. The plurality of first key recesses 166 and the plurality of second key recesses 146 are formed on the surfaces facing each other.

The first key recess 166 of the second scroll 160 and the second key recess 146 of the frame 140 are formed to be sufficiently long in a radial direction as compared with the first key portion 175 and the second key portion 176 of the Oldham ring 170 and are formed so as to have a width substantially in contact with the side surfaces of the first key portion 175 and the second key portion 176 in the circumferential direction.

The first key portion 175 and the second key portion 176 of the Oldham ring 170 slide in the radial direction to the first key recess 166 of the second scroll 160 and the second key recess 166 of the frame 160, while transferring a force in the circumferential direction.

Therefore, in the present embodiment, the friction preventing members 180 may be inserted between the circumferential side surface of the first key portion 166 and the circumferential side surface of the first key portion 175 and between the circumferential side surface of the second key recess 146 and the circumferential side surface of the second key portion 176, respectively. The friction preventing members 180 may be formed of a material having rigidity higher than that of the second scroll 160 or the frame 140 or the Oldham ring 170, that is, made of a material different from that of the second scroll 160, the frame 140, or the Oldham ring 170.

Then, when the first key portion 175 and the second key portion 176 slide relative to the first key recess 166 and the second key recess 146 respectively, it is possible to prevent the key portion, which is a homogeneous material, from coming into direct contact with the key recess. Then, the second scroll 160, the frame 140, or the Oldham ring 170 are all formed of a lightweight material and wearing of the key recess of the second scroll 160 or the frame 140 or the key portion of the Oldham ring 170 may be suppressed.

Hereinafter, the wear preventing member and the key recess into which the wear preventing member is inserted will be described in detail. The first key recess, the first key portion, and the friction preventing member provided therebetween are the same as the second key recess, the second key portion, and the friction preventing member provided therebetween, respectively. Therefore, the first key recess and the first key portion, and the friction preventing member inserted between the first key recess and the first key portion will be mainly described.

Referring to FIGS. 3 and 4 again, the first key recess 166 is formed in a slit shape having a predetermined length in the radial direction. The first key recess 166 has a first key recess surface 166*a* and a second key recess surface 166*b* facing each other in the circumferential direction, and a front surface forming the bottom surface in the axial direction forms a third key recess surface 166*c* and the opposite rear surface forms an opening surface 166*d* in the axial direction. An outer opening surface 166*e* is formed at the outer end to allow the first key portion 175 to enter and exit and an inner opening surface 166*f* is formed at the inner end to communicate with an escape preventing recess 167 to be described later.

As illustrated in FIG. 5, the first key recess surface 166*a* and the second key recess surface 166*b* are formed parallel to each other in the radial direction, and an interval L1 (hereinafter, first space) between the first key recess surface 166*a* and the second key recess surface 166*b* is shorter than a radial length L2 (hereinafter, second length) of the first key recess surface 166*a* and the second key recess surface 166*b*.

The inner opening surface 166*f* may be formed to be closed in a semicircular shape at the inner ends of the first key recess surface 166*a* and the second key recess surface 166*b*. However, in this embodiment, the escape preventing recess 167 is formed so as to fix the friction preventing member 180 to the inner opening surface 166*f*. The escape preventing recess 167 and an escape preventing protrusion 182 of the friction preventing member 180 to be described later constitute an escape preventing portion.

The escape preventing recess 167 extends from the inner end of the first key recess surface 166*a* and the second key recess surface 166*b* and is formed closer to a circle than a semicircle. Accordingly, an inner diameter L3 of the escape preventing recess 167 is formed to be larger than the first interval L1, and a length of a virtual line connecting a portion to which one end of the escape preventing recess 167 is connected in the first key recess surface 166*a* and a portion to which the other end of the escape preventing recess 167 is connected in the second key recess surface 166*b* is formed to gradually increase to a radius of the escape preventing recess. In other words, a maximum circumferential length L3 between the inner wall surfaces 167*a* of the escape preventing recess 167 is formed larger than the first interval L1.

The first key portion 175 includes a first key surface 175*a* corresponding to the first key recess surface 166*a* and a second key surface 175*b* corresponding to the second key recess surface 166*b*. Accordingly, the first key portion 175 may have a square or rectangular cross-sectional shape when projected in the axial direction.

When the first key portion 175 is formed to be square (or the same as the radial width of the ring portion), the length of the first key portion 175 in the radial direction is shortened. Then, the inner diameter of the ring portion 171 may be enlarged as the radial length of the first key portion 175 is shortened. Then, a back pressure space 144 of the frame 140 formed inside the ring portion 171 may be widened.

Meanwhile, when the first key portion 175 is formed in a rectangular shape (or is formed larger than the radial width of the ring portion), the length of the first key portion 175 in the radial direction becomes longer and shaking of the Oldham ring 170 is reduced to suppress leakage from the compression chamber.

The radial length L4 of the first key portion 175 is shorter than the radial length of the first key recess 166 having the second length L2. The first key portion 175 slides in a space between the first key recess surface 166*a* and the second key recess surface 166*b* so that the first key portion 175 does not move to the inside of the escape preventing recess 167. If the first key portion 175 moves to the inside of the escape preventing recess 167, the first key portion 175 preferably moves so as to penetrate only less than ½ of the radial length L4 of the first key portion 175 to stably support the first key portion 175.

Meanwhile, the friction preventing member 180 may be formed to be bent in a U-shaped cross-sectional shape on the whole or by molding a polymer material. That is, the friction preventing member 180 may include a first reinforcement surface 181*a* and a second reinforcement surface 181*b* arranged in parallel in the radial direction and a connection surface 182 connecting the first reinforcement surface 181*a* and the second reinforcement surface 181*b* to form an escape preventing portion.

The first reinforcement surface 181*a* and the second reinforcement surface 181*b* are in close contact with the first key recess surface 166*a* and the second key recess surface 166*b* so that an inner side surface of the first reinforcement surface 181*a* and an inner side surface of the second reinforcement surface 181*b* may correspond to each other with a predetermined lubricating interval t the first key surface 175*a* and the second key surface 175*b*.

For example, as illustrated in FIGS. 4 and 5, the connection surface 182 is bent from one end of the first reinforcement surface 181*a* and one end of the second reinforcement surface 181*b* facing each other to extend to connect the first reinforcement surface 181*a* and the second reinforcement surface 181*b*. The first reinforcement surface 181*a* and the second reinforcement surface 181*b* may be brought into close contact with the first key recess surface 166*a* and the second key recess surface 166*b* due to an elastic force of the connection surface 182.

The outer surface of the connection surface 182 is formed so as to be in close contact with the inner circumferential surface of the escape preventing recess 167. For example, an inner diameter L3', which is a maximum distance in the circumferential direction formed by the connection surface 182, is formed to be greater than an interval L1' formed by each inner side surface of the first reinforcement surface 181*a* and the inner side surface of the second reinforcement surface 181*b*. Accordingly, the outer circumferential surface of the connection surface 182 is in close contact with the inner circumferential surface of the escape preventing recess 167 to form an escape preventing protrusion so that separation of the friction preventing member 180 in a direction toward the inner opening surface 166*e* of the first key recess 146 is suppressed.

Here, as shown in FIG. 6, a height of the friction preventing member 180 in the axial direction may be at least equal to a depth of the first key recess 166. However, the height of the friction preventing member 180 in the axial direction may be slightly smaller than the depth of the first key recess 166.

Figure 7:
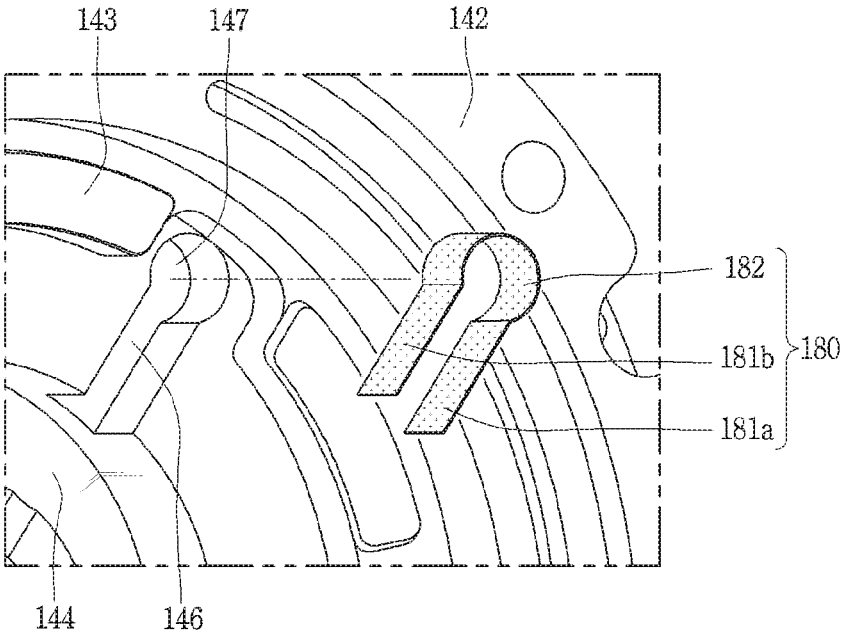
FIGS. 7 and 8 are a perspective view showing a state that a frame and a wear preventing member are separated from each other and a state that the frame and the wear preventing member are coupled in FIG. 3.
Figure 8:
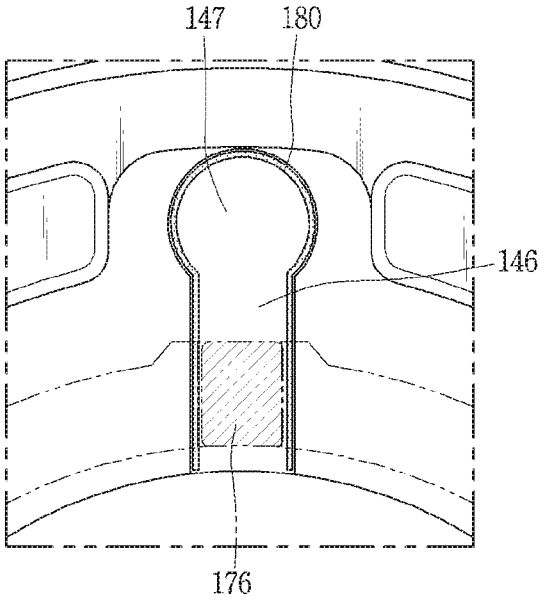

Meanwhile, as described above, the second key recess may be formed in the second frame so that the second key portion of the Oldham ring is slidably inserted. FIGS. 7 and 8 are a perspective view showing a state that the frame and the wear preventing member are separated from each other in FIG. 3 and a plan view showing a combined state.

As illustrated, the second key recess 146 of the frame 140 and the second key portion 176 of the Oldham ring 170 may be formed to have the same shape as the first key recess 166 of the second scroll 160 and the first key portion 175 of the Oldham ring 170.

The second key recess 146 and the second key portion 176 and the friction preventing member 180 inserted between the second key recess 146 and the second key portion 176 are different in an inner direction and an outer direction and have the same shape, as compared with the first key recess 166, the first key portion 175, and the friction preventing member 180 inserted between the first key recess 166 and the first key portion 175 described above.

The shape of the friction preventing member 180 and the shape of the escape preventing portion including the escape preventing recess 147 for preventing escape of the friction preventing member 180 are also the same as those of the above-described embodiments. Therefore, detailed description thereof will be omitted.

As described above, the scroll compressor according to the present embodiment has the following operational effects.

That is, as the friction preventing members 180 are inserted between the first key recess 166 and the first key portion 175 and between the second key recess 146 and the second key portion 176, the first key portion 175 of the Oldham ring 170 is prevented from coming into direct contact with the first key recess 166 of the second scroll 160 and the second key portion 176 of the Oldham ring 170 is prevented from coming into direct contact with the second key recess 146 of the frame 140.

Accordingly, even though the second scroll 160, the frame 140, and the Oldham ring 170 are all made of the same material, particularly, formed of aluminum having a hardness lower than that of cast iron, it is possible to suppress deterioration of the frictional characteristics between the Oldham ring 170 and the second scroll 160 and between the Oldham ring and the frame 140, thereby improving reliability of the compressor.

In addition, since the second scroll 160, the frame 140, and the Oldham ring 170 are all formed of a lightweight aluminum material, the weight of the compressor may be reduced, and thus, efficiency of the compressor and efficiency of a device employing the compressor such as a vehicle may be increased.

In addition, since the ring portion 171 and the key portions 175 and 176 of the Oldham ring are formed as a single body, the connection portion between the ring portion and the key portion may be sufficiently reinforced. Accordingly, the connection portion between the ring portion 171 and the key portions 175 and 176 may be restrained from being damaged by a force, thereby enhancing reliability of the compressor.

Since the ring portion 171 and the key portions 175 and 176 of the Oldham ring 170 are formed as a single body, a machining error between the ring portion 171 and the key portions 175 and 176 or deformation at the key portions 175 and 176 may be minimized. Accordingly, when the compressor is driven, distortion of the key portion in an undesired direction in the key recess is minimized, thereby suppressing compression loss due to a gap between the wraps.

In addition, since it is not necessary to form a separate coating layer on the surface of the Oldham ring 170, it is possible to lower manufacturing cost of the Oldham ring 170 and suppress damage of the Oldham ring or a friction loss due to delamination of the coating layer.

Meanwhile, in the above-described embodiments, the escape preventing recess may form a kind of storage space. Thus, a certain amount of oil may be stored during the operation of the compressor as well as when the compressor is stopped, and the stored oil may flow between the key recess and the key portion, more precisely, between the key portion and the friction preventing member to lubricate them. This may more effectively suppress wearing of the key portion. Therefore, the bottom surface of the escape preventing recess 167 may have the same height as the bottom surface of the first key recess 166 forming the third key recess 166*c*.

Figure 9:
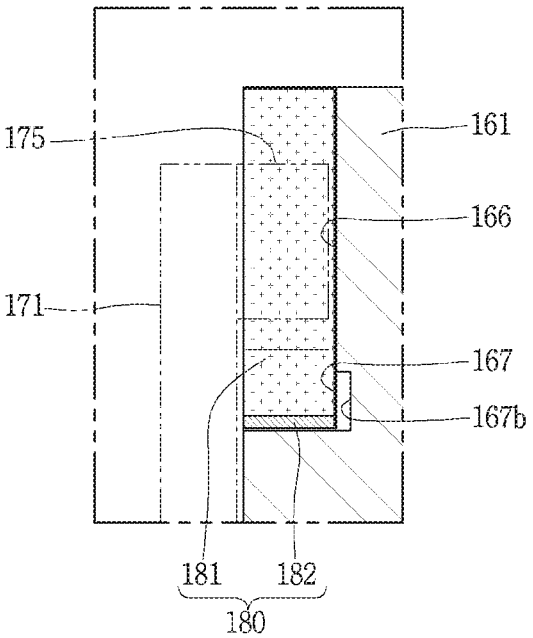
FIG. 9 is a cross-sectional view showing an example in which an oil storage recess is provided in a key recess of an orbiting scroll according to the present invention.

However, as shown in FIG. 9, the depth of the bottom of the escape preventing recess 167 may be formed to be deeper than the depth of the bottom of the first key recess 166. Accordingly, an oil storage recess 167*b* may be formed on the bottom surface of the escape preventing recess 167.

The oil storage recess 167*b* may be formed on the bottom surface of the escape preventing recess as described above, but it is not necessarily limited to the escape preventing recess. That is, the oil storage recess 167*b* may be formed outside the range of movement of the key portion. For example, even though a separate escape preventing recess is not formed, a semicircular recess is formed at the end of the key recess in terms of machining, and the oil storage recess 167*b* may be formed in the recess.

When the oil storage recess 147*b* is formed in the escape preventing recess 147 as described above, the oil flowing into the first key recess 166 is contained in the oil storage recess 167*b* and a certain amount of oil may be supplied between the first key recess 166 and the first key portion 175 during the operation of the compressor.

Figure 10:
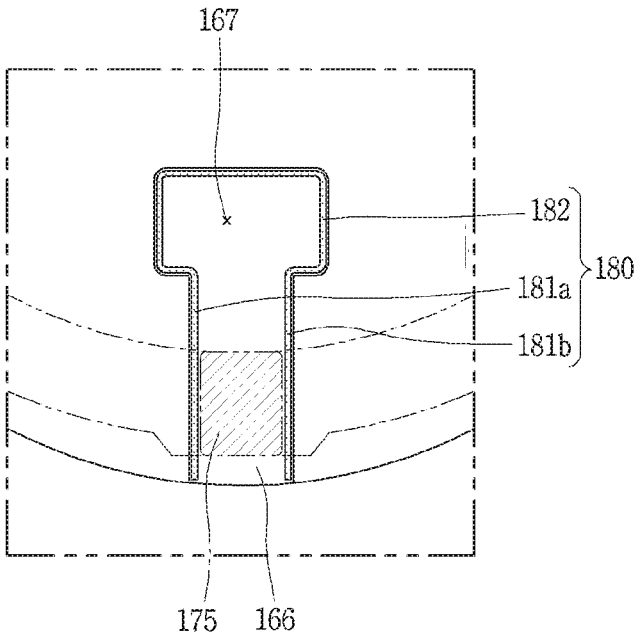
FIG. 10 is a plan view showing another embodiment of an escape preventing protrusion of a wear preventing member according to the present invention.

Meanwhile, in the above-described embodiment, the connection surface forming the escape preventing protrusion is formed in a circular shape, or the connection surface 182 may be formed in a quadrangular shape as shown in FIG. 10. In this case, it is preferable that the escape preventing recess 167 is formed in the same shape as the connection surface 182, that is, a quadrangular shape.

As described above, since the escape preventing recess 167 and the connection surface 182, i.e., the connection surface 182 forming the escape preventing protrusion, are formed in a quadrangular shape, the radial bearing force for the friction preventing member 180 may be further improved. As a result, it is possible to more effectively suppress escape of the friction preventing member 180.

In addition, another embodiment of the structure for fixing the friction preventing member according to the present invention is as follows.

Figure 11:
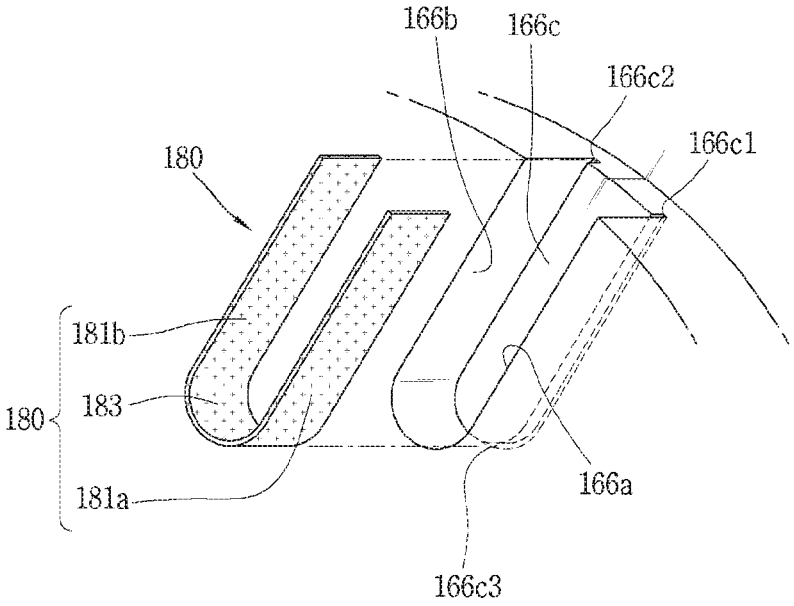
FIGS. 11 and 12 are a perspective view and an assembled plan view showing another embodiment of an escape preventing portion of a wear preventing portion according to the present invention.
Figure 12:
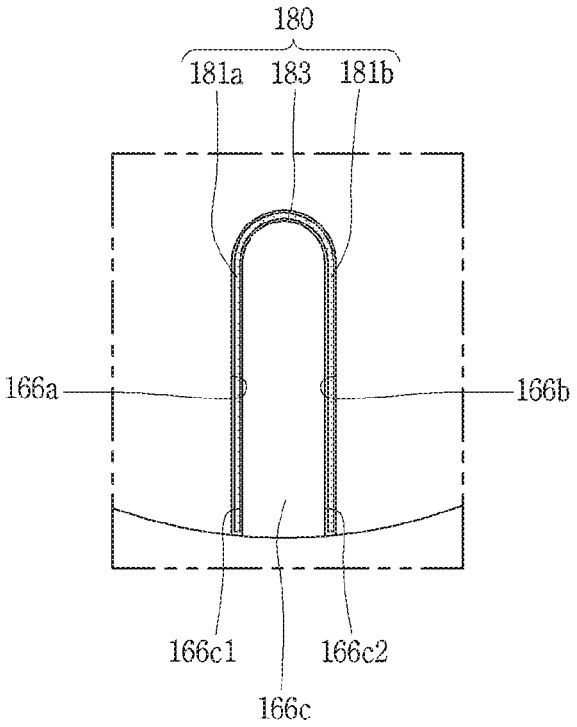

That is, in the above-described embodiments, the connection surface of the friction preventing member is inserted and fixed to the escape preventing recess, but in this embodiment, the first and second reinforcement surfaces of the friction preventing member are inserted into the escape preventing recess to support it. FIG. 11 is an exploded perspective view explaining another embodiment of an escape preventing portion of a wear preventing member according to the present invention, and FIG. 12 is a schematic view for explaining an inner diameter of a key recess according to FIG. 11.

As shown in this figure, in this embodiment, the escape preventing recess is not formed on the outer side of the first key recess 166, and a first escape preventing recess 166*c*1 is formed inside the first key recess 167, that is, on an inner side of the key recess surface 166*a* vertically in contact with the bottom surface, and a second escape preventing recess 166*c*2 is formed on an inner side of the second key recess surface 166*b*.

The first escape preventing recess 166*c*1 and the second escape preventing recess 166*c*2 are formed parallel to each other like the first key recess surface 166*a* and the second key recess surface 166*b*, and an outer end of the first escape preventing recess 166*c*1 and an outer end of the second escape preventing recess 166*c*2 are formed to substantially coincide with the outer ends of the first key recess surface 166*a* and the second key recess surface 166*b*.

A third escape preventing recess 166*c*3 is formed in such a manner that an inner side is vertically in contact with the bottom surface of the first key recess 166. The third escape preventing recess 166*c*3 connects inner ends of the first escape preventing recess 166*c*1 and the escape preventing recess 166*c*2. The third escape preventing recess 166*c*3 is formed as a curved surface, but may be formed as a straight surface depending on a case.

Here, the first escape preventing recess 166*c*1, the second escape preventing recess 166*c*2, and the third escape preventing recess 166*c*3 are formed to have the same depth and are formed to have a depth such that one end of the friction preventing member 180 in the axial direction is inserted and supported.

As described above, even when the escape preventing recesses 166*c*1 to 166*c*3 for preventing the friction preventing member 180 from escaping are formed inside the first key recess 166 instead of being formed outside the first key recess 166, it is possible to effectively support escape of the friction preventing member 180.

Further, in this case, as viewed from the position of the second key recess, since the escape preventing recess is not formed on the outer side of the second key recess 146 in the radial direction, the second key recess 146 may be moved to the outside by the radius of the escape preventing recess. Accordingly, the inner diameter of the Oldham ring 170 may be enlarged greatly to enlarge an inner diameter D1 of the back pressure space 144. Accordingly, the area of the back pressure space 144 may be enlarged to enlarge the area of a back pressure applied to the second scroll 160 and a behavior of the second scroll 160 may be stabilized.

In addition, another embodiment of the structure for fixing the friction preventing member according to the present invention is as follows.

That is, in the above-described embodiments, the friction preventing member is fixed using the escape preventing recess provided around the key recess, or the wear preventing member is fixed with a separate fixing pin as in the present embodiment.

Figure 13:
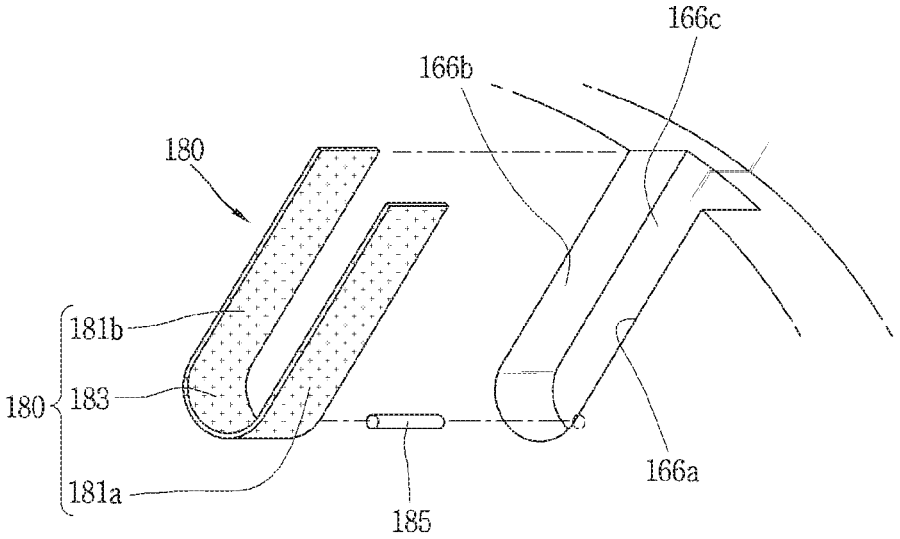
FIGS. 13 and 14 are a perspective view and an assembled plan view showing another embodiment of an escape preventing portion according to the present invention.
Figure 14:
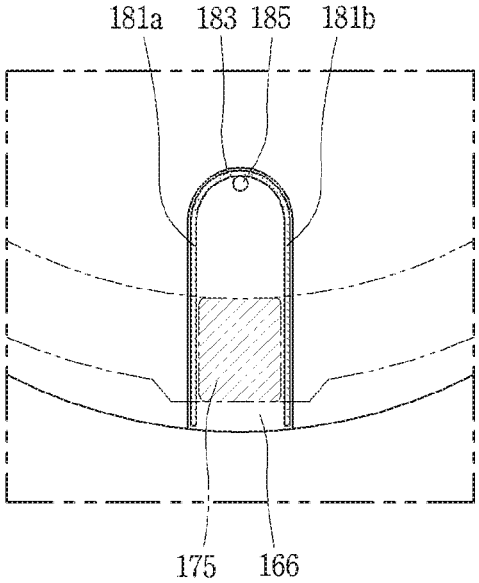

For example, as shown in FIGS. 13 and 14, a fixing pin 185 may be press-fitted to the inner side of the connection surface 182 of the friction preventing member 180, which is the deepest side of the first key recess 166, that is, farthest from the center, and the connection surface 183 of the friction preventing member 180 may be supported in the radial direction by the fixing pin 185.

In this case, it is not necessary to form an additional escape preventing recess in the periphery of the first key recess 166, and it is not necessary to enlarge the connection surface of the friction preventing member. Therefore, even in this case, it is easy to machine the key recess and to manufacture the friction preventing member.

Further, in this case as well, from the viewpoint of the second key recess, it is not necessary to form a separate escape preventing recess, and thus, the inner diameter of the Oldham ring may be enlarged, thereby enlarging the area of the back pressure space to stabilize the behavior of the second scroll.

In addition, another embodiment of the structure for fixing the friction preventing member according to the present invention is as follows.

Figure 15:
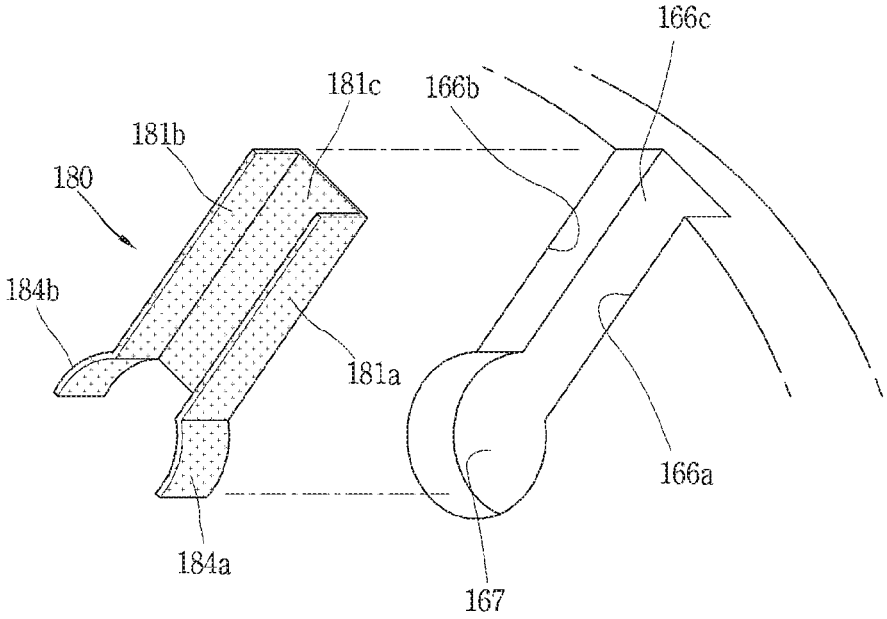
FIGS. 15 and 16 are a perspective view and an assembled plan view showing another embodiment of a wear preventing member according to the present invention.
Figure 16:
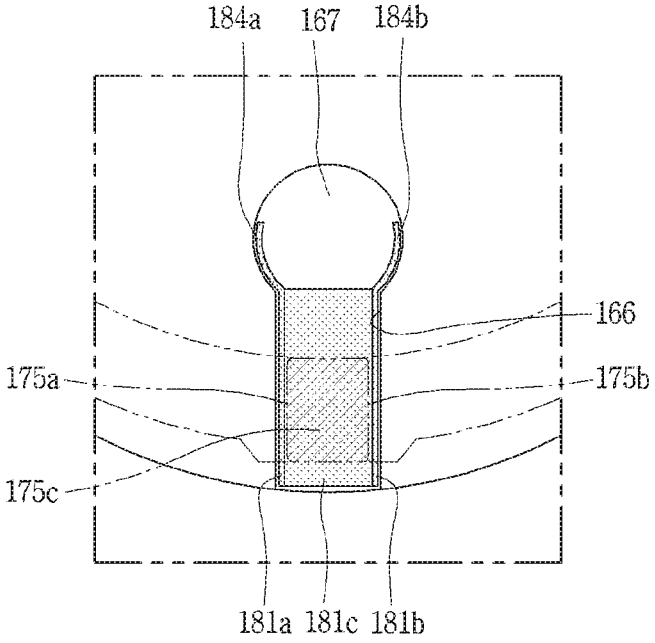

That is, in the above-described embodiments, the friction preventing member is provided only on both the key recess surfaces of the key recess. However, in this embodiment, the friction preventing member is provided on the bottom surface as well as on both the key recess surfaces of the key recess. FIGS. 15 and 16 are a perspective view and an assembled plan view of another embodiment of a wear preventing member according to the present invention.

As shown in the figure, the friction preventing member 180 according to the present embodiment may include a first reinforcement surface 181*a*, a second reinforcement surface 181*b*, and a third reinforcement surface 181*c* formed between the first reinforcement surface 181*a* and the second reinforcement surface 181*b*.

The first reinforcement surface 181*a* and the second reinforcement surface 181*b* are formed in parallel to each other and the third reinforcement surface 181*c* is bent from one axial end where first reinforcement surface 181*a* and the second reinforcement surface 181*b* face each other to extend in the circumferential direction to connect the first reinforcement surface 181*a* and the second reinforcement surface 181*b*.

The third reinforcement surface 181*c* corresponds to the bottom surface of the first key recess 166. Accordingly, the friction preventing member 180 is formed to cover the entire inner surface of the first key recess 166, except for the axial opening surface 166*d* of the opened first key recess 166.

Here, in the first reinforcement surface 181*a* and the second reinforcement surface 181*b*, escape preventing surfaces 184*a* and 184*b* may further be formed to be bent from the facing one ends of the first reinforcement surface 181*a* and the second reinforcement surface 181*b* in the circumferential direction to radially supporting the friction preventing member 180.

The escape preventing surfaces 184*a* and 184*b* may be formed in an arc shape extending from the first reinforcement surface 181*a* and the second reinforcement surface 181*b*, respectively. In this case, the above-described escape preventing recess 167 are formed on the inner side of the first key recess 166 in the radial direction so that the both escape preventing surfaces 184*a* and 184*b* may be brought into close contact with the inner surface of the escape preventing recess 167.

In this case as well, it is also possible to form an escape preventing recess (not shown) on the bottom surface of the first key recess 166 to insert the third reinforcement surface 181*c* into the escape preventing recess, and the first reinforcement surface 181*a* and the second reinforcement surface 181*b* may be resiliently compressed to the first key recess surface 166*a* and the second key recess surface 166*b* using the third reinforcement surface 181*c*.

As described above, when the friction preventing member 180 is formed of the first reinforcement surface 181*a*, the second reinforcement surface 181*b*, and the third reinforcement surface 181*c*, the friction preventing member 180 covers even the third key surface 175*c* corresponding to the bottom surface of the first key recess 166, as well as the first key surface 175*a* and the second key surface 175*b* of the first key portion 175. Accordingly, even though a phenomenon that the second scroll 160 which is an orbiting scroll tilts during a process of an orbiting movement, direct contacting between the bottom surface of the first key recess 166 and the third key surface 175*c* of the first key portion 175 may be suppressed.

In the above-described embodiments, although the example in which the Oldham ring is provided between the frame and the orbiting scroll and is slidably engaged with the frame and the second scroll has been described, but the Oldham ring may be slidably coupled to the key recess provided in the fixed scroll and the key recess provided in the orbiting scroll between the fixed scroll and the orbiting scroll.

Although the electric scroll compressor in which the casing is installed in the horizontal direction has been described in the above embodiments, the present invention may also be applied to a general scroll in which the casing is installed in a longitudinal direction.

In the above-described embodiments, the low-pressure type scroll compressor in which the internal space of the casing is formed as the suction space has been described. However, the present invention may be equally applied to a high-pressure type scroll compressor in which an internal space of the casing forms a discharge space.

The foregoing embodiments and advantages are merely exemplary and are not to be considered as limiting the present disclosure. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A scroll compressor comprising:

a first scroll;

a second scroll engaged with the first scroll and configured to form a compression chamber with the first scroll when performing an orbiting movement with respect to the first scroll;

an Oldham ring including a ring portion formed in an annular shape and a key portion protruding from the ring portion, wherein the key portion is slidably coupled to a key recess formed in the second scroll to enable the second scroll to perform the orbiting movement with respect to the first scroll, wherein the key portion of the Oldham ring is formed of a same material as the second scroll, and a wear preventing member provided between the key recess of the second scroll and the key portion of the Oldham ring, wherein the wear preventing member includes a first reinforcement surface and a second reinforcement surface arranged in parallel in a radial direction and a connection surface connecting the first reinforcement surface and the second reinforcement surface, and the connection surface extends from first ends of the first reinforcement surface and the second reinforcement surface in a radial direction to connect the first reinforcement surface and the second reinforcement surface, and wherein a maximum inner diameter of the connection surface in a circumferential direction is formed to be larger than a circumferential interval between parallel portions of the first reinforcement surface and the second reinforcement surface, and an escape preventing recess into which the connection surface is inserted to support the wear preventing member in the radial direction is formed at one end of the key recess, and a maximum inner diameter of the escape preventing recess in a circumferential direction is formed to be larger than a circumferential interval between parallel first and second key recess surfaces facing the parallel portions of the first reinforcement surface and the second reinforcement surface.

2. The scroll compressor of claim 1, wherein the wear preventing member is formed of a material different from the second scroll and different from the key portion of the Oldham ring.

3. The scroll compressor of claim 2, wherein the key portion and the ring portion of the Oldham ring are formed of the same material.

4. The scroll compressor of claim 3, wherein the key portion and the ring portion of the Oldham ring are formed as a single body.

5. The scroll compressor of claim 1, wherein an oil storage recess is formed to be deeper than a bottom surface of the key recess in the second scroll, the oil storage recess being formed in the escape preventing recess so as to be in fluid communication with the key recess at a position outside a movement range of the key portion in the key recess.

6. The scroll compressor of claim 1, wherein the connection surface and the escape preventing recess are formed in an arc shape, respectively.

7. A scroll compressor comprising:

a casing;

a driving motor in which a stator is located in an inner space of the casing and fixed to the casing, and a rotor is rotatably supported in the stator;

a first scroll provided on one side of the driving motor;

a second scroll engaged with the first scroll to form a compression chamber with the first scroll while performing an orbiting movement with respect to the first scroll, and the second scroll including a plurality of first key recesses;

a rotating shaft with one end coupled to the rotor of the driving motor and the other end eccentrically coupled to the second scroll so as to overlap with the compression chamber in an axial direction;

a frame provided on the driving motor side of the first scroll with the second scroll interposed between the frame and the first scroll and the frame including a plurality of second key recesses;

an Oldham ring having a ring portion located between the frame and the second scroll and a plurality of key portions protruding from the ring portion and slidably inserted into the first key recesses and the second key recesses; and a wear preventing member formed of a material different from the Oldham ring and different from the second scroll and provided between at least one of the first key recesses or the second key recesses and the key portion of the Oldham ring inserted therein, wherein the wear preventing member includes a first reinforcement surface and a second reinforcement surface arranged in parallel in a radial direction and a connection surface connecting the first reinforcement surface and the second reinforcement surface, and the connection surface extends from first ends of the first reinforcement surface and the second reinforcement surface in a radial direction to connect the first reinforcement surface and the second reinforcement surface, and wherein a maximum inner diameter of the connection surface in a circumferential direction is formed to be larger than a circumferential interval between parallel portions of the first reinforcement surface and the second reinforcement surface, and an escape preventing recess into which the connection surface is inserted to support the wear preventing member in the radial direction is formed at one end of the key recess, and a maximum inner diameter of the escape preventing recess in a circumferential direction is formed to be larger than a circumferential interval between parallel first and second key recess surfaces facing the parallel portions of the first reinforcement surface and the second reinforcement surface.

8. The scroll compressor of claim 7, wherein the connection surface and the escape preventing recess are formed in an arc shape, respectively.

9. The scroll compressor of claim 7, wherein the Oldham ring is formed of a same material as the second scroll or the frame.

10. The scroll compressor of claim 9, wherein the ring portion and the plurality of key portions of the Oldham ring are formed of the same material and are formed as a single body.

11. The scroll compressor of claim 7, wherein the wear preventing member is inserted into at least one of the first key recesses or the second key recesses.

* * * * *